US005975988A

United States Patent [19]

Christianson

[11] Patent Number: 5,975,988

[45] Date of Patent: Nov. 2, 1999

[54] COATED ABRASIVE ARTICLE, METHOD FOR PREPARING THE SAME, AND METHOD OF USING A COATED ABRASIVE ARTICLE TO ABRADE A HARD WORKPIECE

[75] Inventor: Todd J. Christianson, Oakdale, Minn.

[73] Assignee: Minnesota Mining and Manfacturing Company, St. Paul, Minn.

[21] Appl. No.: 08/908,122

[22] Filed: Aug. 11, 1997

Related U.S. Application Data

[63] Continuation of application No. 08/316,259, Sep. 30, 1994, abandoned.

[51] Int. Cl.[6] ..... B24B 11/00

[52] U.S. Cl. ..... 451/28; 451/527; 451/530; 51/295

[58] Field of Search ..... 451/527, 529, 451/530, 532, 537, 539; 51/295, 298, 307, 309

[56] References Cited

U.S. PATENT DOCUMENTS

| | | | |
|---|---|---|---|
| 1,412,309 | 4/1922 | Lambert . | |
| 2,001,911 | 5/1935 | Wooddell et al. . | |
| 2,194,472 | 3/1940 | Jackson . | |
| 2,216,728 | 10/1940 | Benner et al. . | |
| 2,404,207 | 7/1946 | Ball . | |
| 2,682,733 | 7/1954 | Buckner . | |
| 3,916,584 | 11/1975 | Howard et al. . | |
| 3,982,359 | 9/1976 | Elbel et al. . | |
| 3,986,847 | 10/1976 | Balson . | |
| 4,018,574 | 4/1977 | Dyer . | |
| 4,256,467 | 3/1981 | Gorsuch . | |
| 4,311,489 | 1/1982 | Kressner . | |
| 4,364,746 | 12/1982 | Bitzer et al. . | |
| 4,393,021 | 7/1983 | Eisenberg et al. . | |
| 4,541,842 | 9/1985 | Rostoker . | |
| 4,575,384 | 3/1986 | Licht et al. . | |
| 4,652,275 | 3/1987 | Bloecher et al. . | |
| 4,799,939 | 1/1989 | Bloecher et al. . | |
| 4,833,834 | 5/1989 | Patterson et al. . | |
| 4,871,376 | 10/1989 | DeWald . | |
| 5,011,513 | 4/1991 | Zador et al. | 51/295 |
| 5,039,311 | 8/1991 | Bloecher . | |
| 5,055,113 | 10/1991 | Larson et al. | 51/295 |
| 5,152,917 | 10/1992 | Pieper et al. . | |
| 5,201,916 | 4/1993 | Berg et al. . | |
| 5,314,513 | 5/1994 | Miller et al. . | |
| 5,318,604 | 6/1994 | Gorsuch et al. . | |
| 5,489,235 | 2/1996 | Gagliardi et al. | 451/527 |

FOREIGN PATENT DOCUMENTS

| | | | |
|---|---|---|---|
| 0 052 758 | 6/1982 | European Pat. Off. . | |
| 0 395 088 | 10/1990 | European Pat. Off. . | |
| 0 648 576 | 4/1995 | European Pat. Off. . | |
| 2941298-A1 | 4/1981 | Germany . | |
| 6-190737 | 6/1994 | Japan . | |
| WO 93/12911 | 7/1993 | WIPO | B25D 11/00 |

OTHER PUBLICATIONS

Jae M. Lee et al., "Camshaft Grinding Using Coated Abrasive Belts," *Transactions of the North American Manufacturing Research Institution of SME,* vol. XXI, 1993.

*Primary Examiner*—Robert A. Rose
*Attorney, Agent, or Firm*—Gregory J. Feulner

[57] ABSTRACT

A coated abrasive having a backing and an abrasive layer coated on the first major of the backing, wherein a cross-section of the abrasive layer normal to the thickness and at a center point of the thickness has a total cross-sectional area of abrasive agglomerates which is substantially the same as that at a point along the thickness which is 75% of a distance the same as that at a point and the contact side; a coated abrasive article having a bond system with a Knoop hardness number of at least 70; a coated abrasive article comprising abrasive agglomerates in the shape of a truncated four-sided pyramid; a method of making the coated abrasive article; and a method of abrading a hard workpiece using a coated abrasive article.

33 Claims, 1 Drawing Sheet

COATED ABRASIVE ARTICLE, METHOD FOR PREPARING THE SAME, AND METHOD OF USING A COATED ABRASIVE ARTICLE TO ABRADE A HARD WORKPIECE

This is a continuation of application Ser. No. 08/316,259 filed Sep. 30, 1994, now abandoned.

FIELD OF THE INVENTION

This invention pertains to a coated abrasive article having an abrasive layer suitable for abrading very hard workpieces, such as hardened steel, cast iron, ceramics, and stone workpieces as well a method for making such a coated abrasive article. This invention also pertains to a method for using the abrasive article to abrade hard workpieces.

BACKGROUND OF THE INVENTION

Abrasive articles comprising abrasive particles are used to abrade and/or finish a wide variety of materials, commonly referred to as workpieces, in a wide variety of applications. These applications range from high pressure, high stock removal of metal forgings to polishing eyeglasses.

Abrasive particles, which can include grains and/or agglomerates, have a wide range of properties which provide for their application in the abrasives industry. The selection of a particular type of abrasive particle generally depends on the physical properties of the particles, the workpiece to be abraded, the surface properties desired to be achieved, the performance properties of the abrasive particles, and the economics of selecting a particular abrasive particle for a specific application.

Aluminum oxide, or alumina, is one of the most popular abrasive particles used in the production of coated abrasives, e.g., sandpaper. Alumina is used for a great many applications, such as paint sanding, metal grinding, and plastic polishing. Silicon carbide, also a popular abrasive, is generally known as a sharper mineral than alumina, and is used mainly in woodworking, paint, and glass grinding applications. Diamond and cubic boron nitride (hereafter "CBN"), commonly called "superabrasives," are especially desirous in abrading very hard workpieces such as hardened steel, ceramic, cast iron, and stone. Diamond is typically the preferred superabrasive for non-ferrous materials, while CBN is typically the preferred superabrasive for ferrous materials like hardened steel. However, superabrasives such as diamond and CBN can cost up to 1000 times more than conventional abrasive particles, i.e., aluminum oxide, silicon carbide. Therefore, it is desirable to utilize the superabrasives their full extent.

As noted above, abrasive particles can be in the form of single grains or agglomerates. Abrasive agglomerates are composite particles of a plurality of single abrasive grains bonded together by a binder. During abrading, the agglomerates typically erode or break down and expel used single abrasive grains to expose new abrasive grains. Agglomerates can be used in abrasive products such as coated abrasives, non-woven abrasives, and abrasive wheels and provide a long useful life and efficient use of the abrasive particles.

U.S. Pat. No. 2,001,911 discloses an abrasive article having a flexible backing and numerous small portions of bonded abrasive material which are adhered to the backing by a layer of flexible and resilient intermediate material. The bonded abrasive material consists of a plurality of abrasive blocks mounted on the backing and separated from each other on their sides by narrow fissures.

U.S. Pat. No. 2,194,472 discloses an abrasive article comprising a backing, which can be flexible, and a coating of abrasive aggregates which are porous, angular, and unflattened and which comprise a plurality of single abrasive grains bound together by a bond system. Preparation of an abrasive article can entail screening the aggregates to provide aggregate particles of a reasonably uniform size.

U.S. Pat. No. 3,986,847 discloses an abrasive article such as a grinding wheel having an abrasive section comprising an abrasive phase and a vitreous bond. The abrasive phase comprises either CBN alone or in combination with a second abrasive grain having a coefficient of thermal expansion substantially the same as the coefficient of thermal expansion of CBN. The vitreous bond is a glassy bond having a coefficient of thermal expansion substantially the same as the coefficient of thermal expansion of CBN.

U.S. Pat. No. 4,256,467 discloses a flexible abrasive article comprising a flexible non-electrically conductive mesh material and a layer of electro-deposited metal, which contains diamond abrasive material embedded therein, adhered directly to and extending through the mesh material so that the mesh material is embedded in the metal layer.

U.S. Pat. No. 4,393,021 discloses a method for the manufacture of granular grit particles in which the individual grits are mixed with a binding medium and a filler to form a pasty mass. The mass can be extruded, heated to harden the mass, and then the hardened product can be broken into granular grit particles, each including several individual grits.

U.S. Pat. No. 4,799,939 discloses an abrasive article comprising erodible agglomerates containing individual abrasive grains disposed in an erodible matrix comprising hollow bodies and a binder. The individual abrasive grains can include aluminum oxide, carbides such as silicon carbide, nitrides such as CBN, diamond, and flint. Although the binder is preferably a synthetic organic binder, natural organic binders and inorganic binders can also be used. The agglomerates are typically irregular in shape but can be formed into spheres, spheroids, ellipsoids, pellets, rods, or other conventional shapes.

U.S. Pat. No. 4,871,376 discloses a coated abrasive comprising a substrate backing, an abrasive material, and a bond system comprising a resinous adhesive, inorganic filler, and a coupling agent. The coupling agent can be selected from the group consisting of silane, titanate, and zirconaluminate coupling agents.

U.S. Pat. No. 5,039,311 discloses an abrasive article comprising an erodible abrasive granule comprising a plurality of first abrasive grains bonded together by a first binder to form an erodible base agglomerate, the base agglomerate at least partially coated with second abrasive grains bonded to the periphery of the base agglomerate by a second binder. The first and second binder, which can be the same or different, can be organic or inorganic and can contain additives such as fillers, grinding aids, plasticizers, wetting agents, and coupling agents. The first and second abrasive grains can be the same or different and can include aluminum oxide, silicon carbide, diamond, flint, CBN, silicon nitride, and combinations thereof. The base agglomerate is typically irregular in shape but can be formed into spheres, spheroids, ellipsoids, pellets, rods, or other conventional forms.

U.S. Pat. No. 5,152,917 discloses a coated abrasive article comprising a backing have at least one major surface and abrasive composites on the at least one major surface. The abrasive composites comprise a plurality of abrasive grains dispersed in a binder, which may also serve to bond the abrasive composites to the backing, and have a predetermined shape, for example, pyramidal.

U.S. Pat. No. 5,201,916 discloses an abrasive particle prepared by introducing a boehmite sol into a mold in which the mold cavities are of a specified shape, removing a sufficient portion of the liquid from the sol to form a precursor of the abrasive particle, removing the precursor from the mold, calcining the removed precursor, and sintering the calcined precursor to form the abrasive particle. The mold cavity has a specified three-dimensional shape and can be a triangle, circle, rectangle, square, or inverse pyramidal, frusto-pyramidal, truncated spherical, truncated spheroidal, conical, and frusto-conical.

U.S. Pat. No. 5,314,513 discloses an abrasive article having a flexible substrate, at least one layer of abrasive grains bonded to the front side of the substrate by a make coat and optionally one or more additional coats, wherein at least one of the coats comprises a maleimide binder.

U.S. Pat No. 5,318,604 discloses an abrasive article comprising abrasive elements dispersed in a binder matrix. The abrasive elements comprise individual particles of abrasive material, substantially all of which are partially embedded in a metal binder.

German Patent No. OS 2941298-A1, published Apr. 23, 1981, teaches coated abrasive articles comprising abrasive conglomerates, which have a rugged and irregular surface, prepared by intensively mixing abrasive mineral grains with glass frit and binder; processing the mixture; pressing, drying, and sintering the material; and then crushing the material to form the conglomerate.

U.S. Pat. No. 5,549,962 discloses precisely shaped particles comprising an organic-based binder and methods for making such particles. The organic-based binder may contain a plurality of abrasive grits dispersed therein.

Although abrasive articles are generally selected based on their physical properties and the desire to maximize abrading and extend the useful life of the abrasive article, particular considerations arise when the industry desires an abrasive article having a long life which can abrade hard materials, such as camshafts and crankshafts, for example, in a camshaft belt grinder as disclosed in U.S. Pat. No. 4,833,834, while conforming to design tolerances including providing a precision ground workpiece.

SUMMARY OF THE INVENTION

This invention, in one embodiment, provides a coated abrasive article comprising a backing having a first major surface; and an abrasive layer coated on the first major surface, the abrasive layer having a contact side adhered to the first major surface, an opposite side, and a thickness which extends from the contact side to the opposite side, the abrasive layer comprising an organic-based bond system, and a plurality of abrasive agglomerates adhered in the bond system, each of the agglomerates comprising an inorganic binder and a plurality of abrasive grains, and having a substantially uniform size and shape, wherein a cross-section of the abrasive layer normal to the thickness and at a center point of the thickness has a total cross-sectional area of abrasive agglomerates which is substantially the same as that at a point along the thickness which is 75% of a distance between the center point and the contact side.

In another embodiment, this invention provides a coated abrasive article comprising a backing having a first major surface; and an abrasive layer coated on the first major surface, the abrasive layer comprising an organic-based bond system, and a plurality of abrasive agglomerates distributed in the bond system, each of the agglomerates comprising an inorganic binder and a plurality of abrasive grains and being in the shape of a truncated four-sided pyramid.

In yet another embodiment, this invention provides a coated abrasive article comprising a backing having a first major surface; and an abrasive layer coated on the first major surface, the abrasive layer comprising an organic-based bond system, the bond system comprising a binder and inorganic filler particles and having an average Knoop hardness number of at least 70, and a plurality of abrasive agglomerates distributed in the bond system, each of the agglomerates comprising an inorganic binder and a plurality of abrasive grains.

The invention also provides a method of making a coated abrasive article comprising (a) providing a backing having a first major surface; (b) forming an abrasive layer, the abrasive layer having a contact side adhered to the first major surface of the backing, an opposite side, and a thickness which extends from the contact side to the opposite side, wherein a cross-section of the abrasive layer normal to the thickness and at a center point of the thickness has a total cross-sectional area of abrasive agglomerates which is substantially the same as that at a point along the thickness which is 75% of a distance between the center point and the contact side, comprising (1) applying a make coat comprising a first organic-based binder precursor to the first major surface of the backing; (2) providing a plurality of abrasive agglomerates (i) comprising an inorganic binder and a plurality of abrasive grains and (ii) having a substantially uniform size and shape; (3) distributing the agglomerates in the make coat; (4) exposing the make coat to an energy source to at least partially cure the first binder precursor; (5) applying a size coat comprising a second organic-based binder precursor on the abrasive agglomerates; and (6) exposing the size coat to a second energy source to cure the second binder precursor and, optionally, to complete curing of the first binder precursor.

The invention also relates to a method of abrading a hard workpiece having a Rockwell "C" hardness of at least 25 comprising (1) providing a coated abrasive article which comprises a backing and an abrasive layer, the abrasive layer comprises a bond system and abrasive agglomerates, and the agglomerates comprising (a) an inorganic metal oxide binder substantially free of free metal and (b) abrasive grains substantially comprising superabrasive grains; (2) contacting the coated abrasive article with the workpiece under sufficient pressure to cause abrading; and (3) moving the coated abrasive article and the workpiece relative to each other.

Coated abrasive articles having the characteristics described above and methods of preparing the same result in excellent abrading qualities not previously recognized. In particular, it is surprising that the coated abrasive articles of this invention are efficient and effective in grinding hard workpieces. Typically, hard workpieces, such as steel, are ground with bonded wheels to obtain the desired life, cut rate, and workpiece tolerances. Bonded abrasives have two main disadvantages in comparison to coated abrasives. Bonded abrasives need to be dressed and trued to prevent the bonded abrasive from dulling and losing effective cut rate. Additionally, bonded abrasives are rigid and not flexible. This rigidity limits their use in certain abrading applications. For example, it may be desirable to abrade a slight concavity into the back side of a camshaft lobe, which may not be accessible by a bonded abrasive. In contrast, coated abrasive articles are flexible and can be used in this type of abrading application. However, previously known coated abrasives were not believed to be suitable for abrading hard workpieces because they did not provide the proper life. In contrast, the coated abrasive articles of this invention are long-lasting, provide a good cut rate and tolerances, and are flexible.

DETAILED DESCRIPTION OF THE INVENTION

Figure 1:
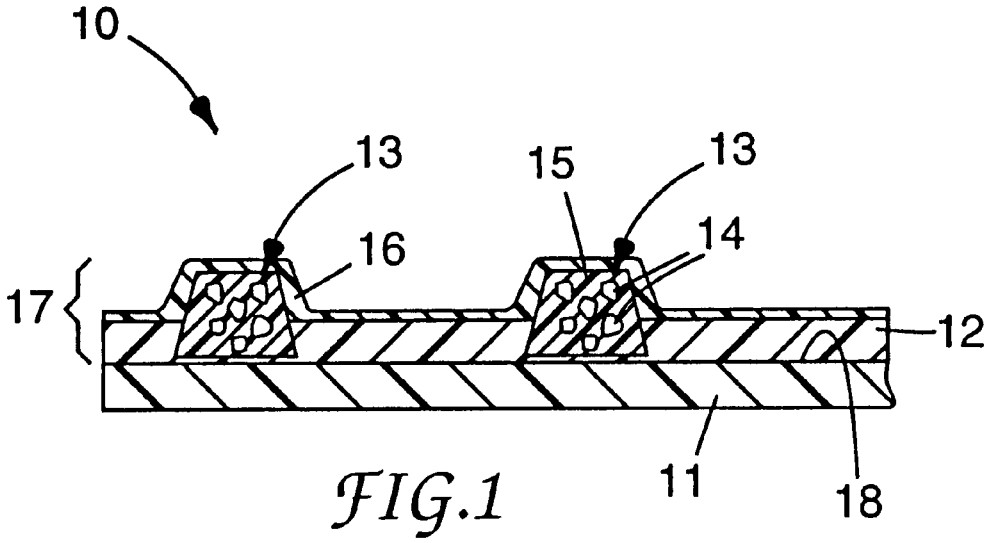
FIG. 1 is an enlarged side view of a cross-sectional segment of a coated abrasive article according to the present invention having truncated four-sided pyramid shaped abrasive agglomerates.

Referring to FIG. 1, a coated abrasive article 10 of the invention comprises a backing 11 having a make coat 12 present on a first major surface 18 of the backing. A plurality of abrasive agglomerates 13 are adhered in the make coat. The make coat serves to bond the abrasive agglomerates to the backing. The abrasive agglomerates comprise a plurality of abrasive grains 14 and metal oxide inorganic binder 15. In this particular embodiment, the abrasive agglomerates are in the shape of a truncated four-sided pyramid. Over the abrasive agglomerates is a size coat 16. One purpose of the size coat is to reinforce adhesion of the abrasive agglomerates on the backing. The make coat, the size coat, and the abrasive agglomerates in this particular embodiment form an abrasive layer 17.

Figure 2:
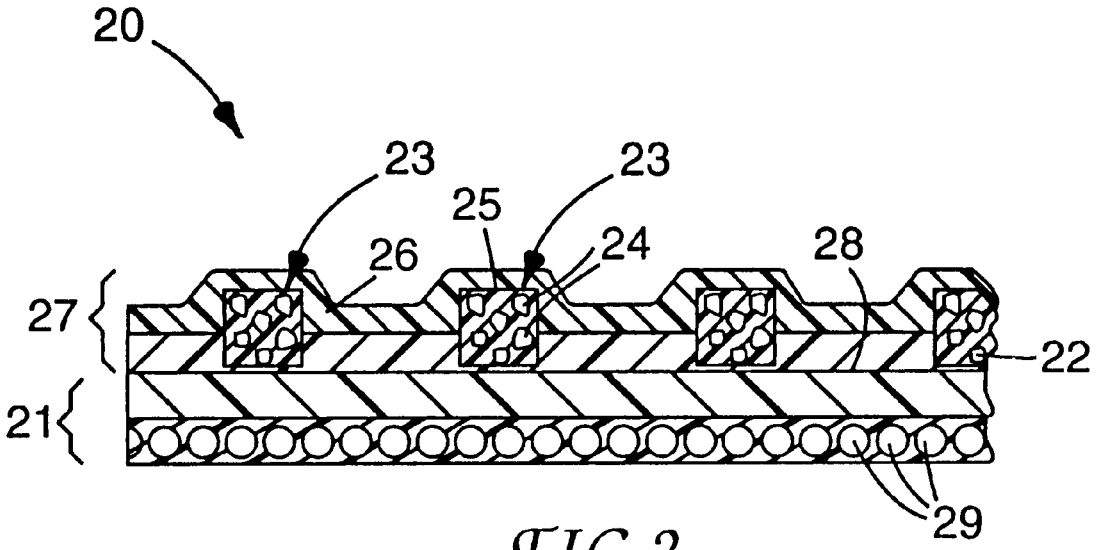
FIG. 2 is an enlarged side view of a cross-sectional segment of another embodiment of the coated abrasive article according to the present invention having cube shaped agglomerates and a fiber reinforced backing.

Referring to FIG. 2, a coated abrasive article 20 of the invention comprises a backing 21 having a make coat 22 which bonds cube-shaped agglomerates 23 on a first major surface 28 of the backing. In this particular embodiment, the backing comprises reinforcing fibers 29 and is, thus, a low stretch backing. The abrasive agglomerates comprise a plurality of abrasive grains 24 and metal oxide inorganic binder 25. Over the abrasive agglomerates is a size coat 26. The make coat, the size coat, and the abrasive agglomerates in this particular embodiment form an abrasive layer 27.

Each element of the embodiments described above will be described individually below.

Backing

The backing used in an abrasive article of the invention has at least two major surfaces. The surface on which the abrasive layer is coated can be designated as the first major surface. Examples of typical backings include polymeric film, primed polymeric film, greige cloth, cloth, paper, vulcanized fiber, nonwovens, and treated versions and/or combinations thereof.

The backing may further comprise optional additives, for example, fillers, fibers, antistatic agents, lubricants, wetting agents, surfactants, pigments, dyes, coupling agents, plasticizers, and suspending agents. The amounts of these optional materials depend on the properties desired. In general, it is preferred that the backing have sufficient strength and heat resistance to withstand its process and use conditions under abrading. Additionally, if the abrasive article is intended to be used in a wet or lubricating environment, the backing preferably has sufficient water and/or oil resistance, obtaining by treating the backing with a thermosetting resin, such as a phenolic resin, which can optionally be modified with rubber, an epoxy resin, which can optionally be modified with a fluorene compound, and/or a bismaleimide resin, so that it does not degrade during abrading.

A preferred backing of the invention is a cloth backing. The cloth typically is composed of yarns in the warp direction, i.e., the machine direction, and yarns in the fill direction, i.e., the cross direction. The cloth backing can be a woven fabric backing, a knitted backing, a stitchbonded fabric backing, or a weft insertion fabric backing. Examples of woven constructions include sateen weaves of four over one weave of the warp yarns. Over the fill (or weft) yarns, twill weave of three over one weave, plain weave of one over one weave, and a drill weave of two over two weave. In a stitchbonded fabric or weft insertion backing, the warp and fill yarns are not interwoven, but are oriented in two distinct directions from one another. The warp yarns are laid on top of the fill yarns and secured to another by a stitch yarn or by an adhesive.

The yarns in the cloth backing can be natural, synthetic, or combinations thereof. Examples of natural yarns include cellulosic material such as cotton, hemp, kapok, flax, sisal, jute, carbon, manila, and combinations thereof. Examples of synthetic yarns include polyester yarns, polypropylene yarns, glass yarns, polyvinyl alcohol yarns, polyaramid yarns, polyimide yarns, aromatic polyamide yarns, rayon yarns, nylon yarns, polyethylene yarns, and combinations thereof. The preferred yarns of this invention are polyester yarns, nylon yarns, polyaramid yams, a mixture of polyester and cotton, rayon yarns, and aromatic polyamide yarns. The cloth backing can be dyed and stretched, desized or heat stretched. Additionally, the yarns in the cloth backing can contain primers, dyes, pigments, or wetting agents and can be twisted or texturized.

Polyester yarns typically are formed from a long chain polymer produced by reacting an ester of dihydric alcohol and terephthalic acid. Preferably, this polymer is linear poly(ethylene terephthalate). There are three main types of polyester yarns: ring spun, open end, and filament. A ring spun yarn typically is made by continuously drafting a polyester yarn, twisting the yarn, and winding the yarn on a bobbin. An open end yarn typically is made directly from a sliver or roving, i.e., a series of polyester rovings are opened and then all of the rovings are continuously brought together in a spinning apparatus to form a continuous yarn. A filament yarn typically is a long continuous fiber and has a very low or non-existent twist to the polyester fiber.

The denier of the fibers of a cloth backing typically is less than about 2000, preferably ranging from about 100 to 1500. For a coated abrasive cloth backing, the weight of the greige cloth, i.e., the untreated cloth, will generally range from about 0.15 to 1 $kg/m^2$, preferably from about 0.15 to 0.75 $kg/m^2$.

The backing may have an optional saturant coat, presize coat, and/or backsize coat to seal the backing and/or protect the yarns or fibers in the backing. The addition of the saturant coat, presize coat, and/or backsize coat may additionally result in a smoother surface on either the front or back side of the backing. Treating cloth backings is further described in U.S. Ser. No. 07/903,360, incorporated herein by reference. These coats generally comprise a resin binder precursor. Examples of such precursors include phenolic resins, which include rubber-modified phenolic resins, epoxy resins, which include fluorene-modified epoxy resins, and aminoplast resins having pendant alpha, beta unsaturated carbonyl groups. After coating, these binder precursors are converted into thermoset binders upon exposure to an energy source, typically, heat. An inorganic filler may also be incorporated into the resin. Examples of such fillers include calcium carbonate, clay, silica, and dolomite. If the backing is a cloth backing, preferably at least one of these three coatings is present and the coating preferably comprises a heat resistant organic resin.

After any one of the saturant coat, backsize coat, or presize coat is applied to the backing, the resulting backing can be exposed to conditions to at least dry and/or solidify the backing treatment, e.g., heating. For example, during heating, which may dry and/or effect cross-linking of the binder precursor, the resulting cloth may be placed in a center frame. The tenter frame tends to minimize any shrinkage and holds the fabric taut. Additionally, after the backing is heated, it can be processed through heated cans to calender the backing. This calendering step can help to smooth out any surface roughness associated with the backing.

The backing used in an abrasive article of the invention preferably is a low stretch backing. A low stretch backing allows for longer and/or fuller utilization of the abrasive material. When the coated abrasive article contains superabrasive grains, the backing preferably is low stretch so that full utilization of the superabrasive grains can be achieved. If the backing stretches too much, the article may improperly track, for example, if the article is an abrasive belt running on drive and/or idler wheels, and full utilization of the superabrasive grains within the agglomerates cannot be achieved.

The term "low stretch" refers to the backing itself defore applying a bond system and abrasive material. A low stretch backing results in a coated abrasive belt that can abrade a workpiece for a period of time which is typically longer than that seen with conventional backings, without unduly stretching on the machine. The concept of "low stretch" can be defined by a tensile test measurement in which the percent stretch of the backing taken at 100 lbs/inch (45 kg/2.5 cm) (using a belt width) generally is less than 10%, typically less than 5%, preferably less than 2%, and more preferably less than 1%. Most preferably, the percent stretch is less than 0.5%.

The following procedure outlines the tensile test in which the backing is tested before application of any portion of the bond system or abrasive material.

Tensile Test

The backing, in the machine direction, is converted into a 2.5 cm by 17.8 cm strip. The strip is installed on a tensile tester, for example, a Sintech machine, available from Systems Integration Technology, Inc., Stoughton, Mass., and the samples are pulled in the machine direction. The percent stretch was measured at 100 lbs (45 kg) and is calculated by the following equation:

$$\frac{\text{length of sample taken at 100 lbs} - \text{original length of sample}}{\text{original length of sample}} \times 100$$

A more preferred backing of a coated abrasive article of this invention includes a laminate of sateen weave polyester cloth with reinforcing fibers. The polyester cloth can be spliced together to form an endless belt. The preferred splice has abutting ends in a plane to define a line that is in the form of a sine wave with the line being covered with a reinforced woven polyester tape. The polyester cloth is believed to provide good adhesion to the organic-based bond system and the abrasive particles or agglomerates, thereby minimizing any shelling, i.e., premature release of the abrasive particles or agglomerates, which is typically undesirable and can shorten the useful life of the coated abrasive. Generally, the reinforcing fibers are laminated with a strong, heat resistant laminating adhesive and the polyester cloth contains a phenolic based saturant and backsize treatment. The reinforced polymeric splice tape comprises either polyester or polyaramid reinforcing yarns embedded in a polyester film and, generally, has a thickness of less than 0.010 inch (0.025 cm).

For example, reinforcing fibers or yarns can be laminated to the backside of the polyester cloth belt, as described in WO 95/22438 incorporated by reference, and can be applied in a continuous manner over the backside of the cloth belt. Generally, the purpose of the reinforcing yarns is to increase the tensile strength and minimize the stretch associated with the backing. Examples of preferred reinforcing yarns include polyaramid fibers, e.g., polyaramid fibers having the trade designation "Kevlar" manufactured by E.I. DuPont, polyester yarns, glass yarns, polyamide yarns, and combinations thereof. Preferably, splices and joints are not associated with the reinforcing yarns so that the reinforcing yarns serve to strengthen the splice and minimizing splice breakage.

Bond System

The bond system is an organic-based bond system which can comprise, for example, an abrasive slurry or at least two adhesive layers, the first of which will be referred to hereafter as the "make coat" and the second of which will be referred to as the "size coat." The abrasive slurry can comprise a mixture of different abrasive particles and is preferably homogenous.

Typically, the make and the size coat are formed from organic-based binder precursors, for example, resins. The precursors used to form the make coat may be the same or different from those used to form the size coat. Upon exposure to the proper conditions, such as an appropriate energy source, the resin polymerizes to form a cross-linked thermoset polymer or binder. Examples of typical resinous adhesives include phenolic resins, aminoplast resins having pendant alpha, beta, unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorine modified epoxy resins, and mixtures thereof. Epoxy resins and phenolic resins are preferred.

Phenolic resins are widely used as binder precursors because of their thermal properties, availability, cost, and ease of handling. There are two types of phenolic resins, resole and novolac. Resole phenolic resins typically have a molar ratio of formaldehyde to phenol, of greater than or equal to one to one, typically between 1.5:1 to 3:1. Novolac resins typically have a molar ratio of formaldehyde to phenol, of less than to one to one. Examples of commercially available phenolic resins include those known by the trade names "Durez" and "Varcum" available from Occidental Chemicals Corp.; "Resinox" available from Monsanto; and "Arofene" and "Arotap" available from Ashland Chemical Co.

Aminoplast resins typically have at least one pendant alpha, beta-unsaturated carbonyl group per molecule or oligomer. Useful aminoplast resins include those described in U.S. Pat. Nos. 4,903,440 and 5,236,472 which are incorporated herein by reference.

Epoxy resins have an oxirane ring and are polymerized by the ring opening. Suitable epoxy resins include monomeric epoxy resins and polymeric epoxy resins and can have varying backbones and substituent groups. In general, the backbone may be of any type normally associated with epoxy resins, for example, Bis-phenol A, and the substituent groups can include any group free of an active hydrogen atom that is reactive with an oxirane ring at room temperature. Representative examples of suitable substituent groups include halogens, ester groups, ether groups, sulfonate groups, siloxane groups, nitro groups and phosphate groups.

Examples of preferred epoxy resins include 2,2-bis[4-(2,3-epoxypropoxy)-phenyl]propane (a diglycidyl ether of bisphenol) and commercially available materials under the trade designation "Epon 828", "Epon 1004", and "Epon 1001F" available from Shell Chemical Co., and "DER-331", "DER-332" and "DER-334" available from Dow Chemical Co. Other suitable epoxy resins include glycidyl ethers of phenol formaldehyde novolac, for example, "DEN431" and "DEN428" available from Dow Chemical Co.

Ethylenically unsaturated resins include both monomeric and polymeric compounds that contain atoms of carbon, hydrogen, and oxygen, and optionally, nitrogen and halogen atoms. Oxygen or nitrogen atoms or both are generally present in ether, ester, urethane, amide, and urea groups. Ethylenically unsaturated compounds preferably have a molecular weight of less than about 4,000, and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, and maleic acid.

Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol trimethocyate, pentaerythritol tetraacrylate and pentaerythritol tetramethocylate.

Other ethylenically unsaturated resins include monoallyl, polyallyl, and polymethallyl esters and amides of carboxylic acids, such as diallyl phthalate, diallyl adipate, and N,N-diallyladipamide. Other suitable nitrogen-containing compounds include tris(2-acryloyl-oxyethyl)isocyanurate, 1,3,5-tri(2-methacryloxyethyl)-s-triazine, acrylamide, methylacrylamide, N-methylacrylamide, N,N-dimethylacrylamide, N-vinylpyrrolidone, and N-vinylpiperidone.

Acrylated urethanes are diacrylate esters of hydroxy terminated NCO extended polyesters or polyethers. Examples of commercially available acrylated urethanes include "Uvithane 782", available from Morton Thiokol Chemical, and "CMD 6600," "CMD 8400," and "CMD 8805," available from Radcure Specialties.

Acrylated epoxies are diacrylate esters of epoxy resins, such as the diacrylate esters of bisphenol A epoxy resin. Examples of commercially available acrylated epoxies include "CMD 3500," "UCMD 3600," and "CMD 3700," available from Radcure Specialties.

The bond system, for example, the make and/or size coat, of this invention can further comprise optional additives, such as, for example, fillers (including grinding aids), fibers, antistatic agents, lubricants, wetting agents, surfactants, pigments, dyes, coupling agents, plasticizers, and suspending agents. The amounts of these materials can be selected to provide the properties desired.

Examples of useful fillers for this invention include metal carbonates (such as calcium carbonate (e.g., chalk, calcite, marl, travertine, marble, and limestone), calcium magnesium carbonate, sodium carbonate, and magnesium carbonate); silica (such as quartz, glass beads, glass bubbles, and glass fibers); silicates (such as talc, clays (e.g., montmorillonite) feldspar, mica, calcium silicate, calcium metasilicate, sodium aluminosilicate, sodium silicate); metal sulfates (such as calcium sulfate, barium sulfate, sodium sulfate, aluminum sodium sulfate, aluminum sulfate); gypsum; vermiculite; wood flour; aluminum trihydrate; carbon black; metal oxides (such as calcium oxide (lime), aluminum oxide (alumina), and titanium dioxide); and metal sulfites (such as calcium sulfite). The filler typically has an average particle size ranging from about 0.1 to 100 micrometers, preferably between 1 to 50 micrometers, more preferably between 1 and 25 micrometers.

Suitable grinding aids include particulate material, the addition of which has a significant effect on the chemical and physical processes of abrading which results in improved performance. In particular, a grinding aid may 1) decrease the friction between the abrasive grains and the workpiece being abraded, 2) prevent the abrasive grain from "capping", i.e. prevent metal particles from becoming welded to the tops of the abrasive grains, 3) decrease the interface temperature between the abrasive grains the workpiece and/or 4) decrease the grinding forces. In general, the addition of a grinding aid increases the useful life of the coated abrasive. Grinding aids encompass a wide variety of different materials and can be inorganic- or organic-based.

Examples of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphthalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include tin, lead, bismuth, cobalt, antimony, cadmium, iron, and titanium. Examples of other grinding aids include sulfur, organic sulfur compounds, graphite, and metallic sulfides. A combination of different grinding aids can be used, for example, as described in WO 95/24991. The above mentioned examples of grinding aids are meant to be a representative showing of grinding aids and are not meant to encompass all grinding aids.

Examples of antistatic agents include graphite, carbon black, vanadium oxide, humectants, and the like. These antistatic agents are disclosed in U.S. Pat. Nos. 5,061,294; 5,137,542; and 5,203,884 incorporated herein by reference.

A bond system of this invention, for example, the make coat and the size coat, generally has a Knoop hardness number (KHN) of least 50 KHN (which can also be expressed in units of $kgf/mm^2$), typically at least about 60 KHN, preferably at least about 70 KHN, more preferably at least about 80 KHN, and most preferably at least about 90 KHN, measured in accordance with ASTM E384-89, in order to be able to withstand grinding forces and not disintegrate.

Generally, if the bond system comprises make and size coats, at least one of the make and size coats can comprise from about 5 to 95 parts by weight, preferably 30 to 70 parts by weight, of a binder precursor, for example, a thermoset resin, and between about 5 to 95 parts by weight, preferably 30 to 70 parts by weight, of a filler. If the bond system comprises an abrasive slurry, the amount of binder precursor can range from 5 to 95 weight % and the amount of filler can range from 5 to 95 weight %, based on the weight of the abrasive slurry.

For example, the preferred Knoop hardness number ranges for the bond system, i.e., preferably at least 70 KHN, more preferably at least 80 KHN, and most preferably at least 90 KHN, can be achieved by the presence of filler particles which are described above. The filler particles will harden the cured thermoset resin and toughen the bond system, for example, the make and size coat. The amount of filler particles and the presence of a coupling agent aid in controlling the Knoop hardness of the bond system.

To achieve the preferred Knoop hardness ranges, a coupling agent may be present on the filler and/or the abrasive particles. The coupling agent provides an association bridge between the bond system and the filler and/or abrasive particles. Examples of suitable coupling agents include organosilanes, zircoaluminates, and titanates. Coupling agents are usually present in an amount ranging between about 0.1 to 5% by weight, preferably 0.5 to 3.0%, based on the total weight of the filler and the abrasive agglomerates.

Preferably, a filler, as described above, can be pre-treated with a coupling agent, for example, an organosilane coupling agent. This type of coupling agent is commercially available from Union Carbide under the trade designation "A-1100". More preferably, calcium metasilicate filler particles and alumina filler particles can be pre-treated with a silane coupling agent. Alternatively, the coupling agent may be added to a mixture of resin and filler. While a combination of filler particles can be used, preferably calcium metasilicate particles are used alone. Treatment with a coupling agent can improve adhesion between the bond system and the abrasive particles. Additionally, the presence of the coupling agent tends to improve the rheology of a binder precursor, e.g., comprising a resole phenolic resin and calcium metasilicate filler particles.

In particular, to achieve a Knoop hardness of at least 70 KHN, the bond system preferably contains 50 to 90 parts by weight of filler and 0.2 to 50 parts by weight of a coupling agent, based on the weight of the bond system. For example, the make coat and/or the size coat can comprise 35 parts by weight of a cross-linked resole phenolic resin and 65 parts by weight of calcium metasilicate and alumina filler particles, which have been pre-treated with 0.5 parts by weight of a coupling agent, based on the weight of the make and/or size coat. If a combination of particles is used, for example, calcium metasilicate and alumina filler particles, the average particle size can range from 0.2 to 50, preferably 1 to 25, and more preferably 2 to 10, micrometers.

Peripheral Coating Layer

The bond system can comprise a peripheral coating layer. For example, if the bond system comprises a make coat and a size coat, the peripheral coating layer, also known as a supersize coating, can be coated over the size coat or the peripheral coating layer can be coated over an abrasive slurry. The peripheral coating layer can be formed from an organic-based binder precursor, for example, resins, as described for the make and size coats and can comprise a grinding aid. Suitable grinding aids include those described above for the bond system. For example, a peripheral coating layer can comprise potassium tetrafluoroborate particles distributed throughout a cross-linked epoxy resin. The peripheral coating layer is usually roll or spray coated onto the cured size coat or slurry and is cured separately from the size coat/abrasive slurry.

Abrasive Particles

Abrasive particles used in coated abrasive articles of this invention include agglomerates comprising a plurality of abrasive grains bonded together by an inorganic binder to form a discrete mass. Abrasive agglomerates as opposed to individual abrasive grains in an abrasive article offer the advantage of longer life, since the abrasive agglomerate is composed of a multitude of abrasive grains. During use, worn and used abrasive grains are expelled from the abrasive agglomerate, thereby exposing new and fresh abrasive grains.

Useful abrasive agglomerates generally have an average particle size ranging from about 20 to about 3000 micrometers, preferably between 50 to 2000 micrometers and more preferably between 200 to 1500 micrometers.

Each of the abrasive agglomerates comprise an inorganic binder and a plurality of abrasive grains. Examples of suitable abrasive grains include those made of fused aluminum oxide, ceramic aluminum oxide, heated treated aluminum oxide, silicon carbide, alumina zirconia, ceria, garnet, boroncarbonitride, boron oxides in the form of $B_6O$ and $B_{10}O$, diamond, CBN, and combinations thereof. Examples of ceramic aluminum oxide are disclosed in the following U.S. Pat. Nos. 4,314,827; 4,770,671, 4,744,802; 4,881,951; 5,011,508; 5,139,978; 5,164,348; 5,201,916; and 5,213,591 all incorporated herein by reference.

Preferably, the abrasive grains are "superabrasive" grains or substantially comprise "superabrasive grains". "Superabrasive" grains typically have a hardness of at least about 35 GPa, preferably at least about 40 GPa, e.g., diamond, CBN, or combinations thereof. Preferably, the abrasive grain is CBN. The term "substantially comprise" used to describe superabrasive grains means that at least 30%, preferably 50%, more preferably 75%, and up to 100% of the abrasive grains are superabrasive grains.

Superabrasive grains are especially efficacious in abrading very hard workpieces such as hardened steel, ceramics, cast iron, and stone. Superabrasive grains, both diamond and CBN, are commonly available from many commercial sources, such as, for instance, General Electric, American Boarts Company, and DeBeers. In particular, diamond grains can be natural or synthetically made. CBN is synthetically made and is available from General Electric Corp. under the trade designation "Borazon." There are various types of diamond and CBN available, each with different qualities. The hardness, toughness, multi- or monocrystalline, natural or synthetic, and grain or particle shape can vary.

The abrasive grains typically have a particle size ranging from about 0.1 to 1500 micrometers, preferably between about 1 to 1300, micrometers. The particle size of the abrasive grain is generally determined by the desired cut rate and surface finish to be produced by the coated abrasive. Since the agglomerates comprise the abrasive grains, the particle size of the abrasive grains in a given agglomerate is substantially smaller than the particle size of the agglomerate so that the agglomerates can comprise a plurality of abrasive grains.

The abrasive grains of this invention may also contain a surface coating. Surface coatings are known to improve the adhesion between the abrasive grain and the binder in the agglomerate and between the agglomerate and the bond system and, therefore, improve the abrading characteristics of the abrasive grains/agglomerates. Suitable surface coatings include those described in U.S. Pat. Nos. 1,910,444; 3,041,156; 5,009,675; 4,997,461, 5,011,508; 5,213,591; and 5,042,991, incorporated herein by reference. For example, diamond and/or CBN may contain a surface treatment, e.g., a metal or metal oxide to improve adhesion to the inorganic binder in the agglomerate. In addition, a coating, such as a thin nickel layer, can be present on the abrasive grain.

Examples of the inorganic binder include inorganic metal oxides such as vitreous binders, glass ceramic binders, and ceramic binder. Preferably, the inorganic metal oxide binder is substantially free of free metals. The term "free metal" means elemental metal and the term "substantially free" typically means than no more than about 1%, preferably 0.5%, more preferably 0.25%, and down to and including 0%, of free metal by weight, based on the total weight of the inorganic metal oxide binder, is present in the inorganic metal oxide binder.

Examples of inorganic metal oxides include silica, silicates, alumina, sodia, calcia, potassia, titania, iron oxide, zinc oxide, lithium oxide, magnesia, boria, lithium aluminum silicate, borosilicate glass, and combinations thereof. Preferably, the inorganic metal oxides are lithium aluminum silicate and borosilicate glass. Inorganic binders can be prepared by melting a milled blend of metal oxides and then cooling the melt to form a solid glass; the glass is then milled to form a fine powder.

Preferably, the coefficient of thermal expansion of the inorganic binder is the same or substantially the same as that of the abrasive grains. When the coefficient of thermal expansion of the inorganic binder is the same or substantially the same as that of the abrasive grains, there is a more uniform shrinkage of both the individual abrasive grains and the inorganic binder during the manufacture of the abrasive agglomerate (e.g., during the vitrification process), which results in less internal stresses at the inorganic binder/abrasive grain interface, which in turn minimizes any premature breakdown of the agglomerates.

The term "substantially"0 referring to the coefficient of thermal expansion typically means that there is less than about 80 percent difference, preferably less than about 50 percent difference, and more preferably less than about 30 percent difference, in the coefficient of thermal expansion of the binder and the coefficient of thermal expansion of the abrasive grains. This embodiment is more preferred when the inorganic binder is a vitrified binder.

For example, CBN has a thermal expansion of about $3.5\times10^{-6}/°$ C. A suitable vitreous binder can have a thermal expansion which differs from the thermal expansion of CBN by less than about 80%, i.e., between about $2.8\times10^{-6}/°$ C. and $4.4\times10^{-6}/°$ C.

In producing a vitrified agglomerate comprising abrasive grains and a vitreous binder, the binder, prior to being vitrified, is preferably ground such that the resulting powder passes through a 325 mesh screen. For example, a preferred vitreous binder comprises, by weight, 51.5% silica, 27.0% boria, 8.7% alumina, 7.5% magnesia, 2.0% zinc oxide, 1.1% calcia, 1.0% sodium oxide, 1.0% potassium oxide and 0.5% lithium oxide. The addition of boria can improve adhesion to the CBN abrasive grains.

In general, each abrasive agglomerate will comprise, by weight, between about 10 to 80%, preferably between about 20 to 60%, inorganic binder and between about 20 to 90%, preferably between about 40 to 80% abrasive grains, based on the weight of the agglomerate.

The abrasive agglomerates may further contain other additives such as fillers, grinding aids, pigments, adhesion promoters, and other processing materials.

Examples of fillers include small glass bubbles, solid glass spheres, alumina, zirconia, titania, and metal oxide fillers, which can improve the erodibility of the agglomerates. Examples of grinding aids include those discussed above. Examples of pigments include iron oxide, titanium dioxide, and carbon black. Examples of processing materials, i.e., processing aids, include liquids and temporary organic binder precursors. The liquids can be water, an organic solvent, or combinations thereof. Examples of organic solvents include alkanes, alcohols such as isopropanol, ketones such as methylethyl ketone, esters, and ethers.

Examples of temporary organic binder precursors, which can be used to make a homogenous, flowable mixture that can be easily processed, include thermoplastic and thermosetting binders such as waxes, polyamides resins, polyesters resins, phenolic resins, acrylate resins, epoxy resins, urethane resins, and urea-formaldehyde resins. Depending upon the chemistry of the inorganic binder selected, a curing agent or cross-linking agent may also be present along with the temporary organic binder precursor. The temporary organic binder helps in the shaping process of the abrasive agglomerate. During the vitrification process, the temporary organic binder decomposes thereby leaving voids in the abrasive agglomerates.

Abrasive agglomerates preferably contain a coating of inorganic particles. The coating results in an increased surface area, thereby improving the adhesion between the bond system and the abrasive agglomerates. Examples of inorganic particles for coating the agglomerates include fillers and abrasive grains, for example, metal carbonates, silica, silicates, metal sulfates, metal carbides, metal nitrides, metal borides, gypsum, metal oxides, graphite, and metal sulfites. Preferably, the inorganic particles are abrasive grains, more preferably the same abrasive grains as in the abrasive agglomerate. The abrasive grains for the coating can also be selected from those described above in the discussion on abrasive grains. The inorganic particles may have the same particle size as the abrasive grains in the abrasive agglomerate, or they may be larger or smaller than the abrasive grains. Preferably, the inorganic particles have a size ranging from about 10 to 500, more preferably 25 to 250, micrometers.

The abrasive agglomerate can also be encapsulated with either an organic or inorganic coating. Thus, the bond system, e.g., make and/or size coats, will only minimally penetrate into an encapsulated abrasive agglomerate.

In one embodiment, each of the agglomerates comprises an inorganic binder and a plurality of abrasive grains, and have a substantially uniform size and shape. When referring to the size and shape of the agglomerate, the phrase "substantially uniform" means that the size and shape of the agglomerates will not vary by more than 50%, preferably 40%, more preferably 30%, and most preferably 20%, from the average size and shape of the agglomerates.

Preferably, each of the agglomerates comprise an inorganic binder and a plurality of abrasive grains and are in the shape of a truncated four-sided pyramid or a cube.

Abrasive Layer

The abrasive layer, as described above, comprises an organic-based bond system and a plurality of abrasive agglomerates. The abrasive layer which is coated over the first major surface of the backing therefore has a side which is adhered to the first major surface (a "contact" side) and an opposite side. The "thickness" of the abrasive layer extends from the contact side to the opposite side and is an imaginary line defining the shortest distance between the contact side and the opposite side.

In one embodiment, a cross-section of the abrasive layer normal to the thickness and at a center point of the thickness has a total cross-sectional area of abrasive agglomerates which is substantially the same as that at a point along the thickness which is 75% of a distance between the center point and the contact side. ("75% of a distance between the center point and the contact side" is calculated from the center point toward the contact side.) The phrase "cross-sectional area of abrasive agglomerates" refers to the amount of abrasive agglomerates available to contact a workpiece within the cross-section of the abrasive layer. When referring the total cross-sectional area of agglomerates, the term "substantially" means that the total cross-sectional area of abrasive agglomerates at the center point of the thickness will not vary by more than 40%, preferably not more than 30%, more preferably not more than 20%, and most preferably not more than 10%, from the point which is 75% of the distance between the center point and the contact side of the abrasive layer.

Dressing and Truing

The abrasive article is preferably trued and dressed before abrading and may be dressed and trued at intervals during abrading. Dressing is a process which removes bond from the abrasive particles and provides clearance for abrading. Truing is a process which levels or evens out the abrading surface thereby resulting in a tighter tolerance during abrading. Truing and dressing of coated abrasives of this invention can be performed, for example, as described in WO 93/02837, incorporated herein by reference.

Method of Making an Abrasive Agglomerate

A method for making an abrasive agglomerate useful in the present invention comprises, for example, mixing starting materials comprising an inorganic binder precursor, abrasive grains, and a temporary organic binder precursor. The temporary organic binder precursor permits the mixture to be more easily shaped and to retain this shape during further processing. Optionally, other additives and processing aids, as described above, e.g., inorganic fillers, grinding aids, and/or a liquid medium may be used.

These starting materials can be mixed together by any conventional technique which results in a uniform mixture. Preferably, the abrasive grains are mixed thoroughly with a temporary organic binder precursor in a mechanical mixing device such as a planetary mixer. The inorganic binder precursor is then added to the resulting mixture and blended until a homogeneous mixture is achieved, typically 10 to 30 minutes.

The mixture is then shaped and processed to form agglomerate precursors. The mixture may be shaped, for example, by molding, extrusion, and die cutting. There will typically be some shrinkage associated with the loss of the temporary organic binder precursor and the, inorganic binder precursor and this shrinkage should taken into account when determining the initial shape and size. The shaping process can be done on a batch process or in a continuous manner. One preferred technique for shaping the abrasive agglomerate is to place the starting materials, which have been combined and formed into a homogenous mixture, into a flexible mold. For example, if abrasive agglomerates in the shape of a truncated pyramid are to be formed, the mold will be imprinted with this shape. The flexible mold can be any mold which allows for easy release of the particles, for example, a silicone mold. Additionally, the mold may contain a release agent to aid in the removal. The mold, containing the mixture, is then placed in an oven and heated to least partially remove any liquid. The temperature depends on the temporary organic binder precursor used and is typically between 35 to 200° C., preferably, 70 to 150° C. The at least partially dried mixture is then removed from the mold. It is also possible to completely destroy, i.e., completely burn off the mold, to release the agglomerates.

As described above, the abrasive agglomerates preferably contain a coating of inorganic particles which increase the surface area and also minimize the aggregation of the abrasive agglomerates with one another during their manufacture. One method to achieve the coating is to mix the agglomerate precursors after they are shaped, e.g., removed from the mold, with the inorganic particles in order to apply the inorganic particles, e.g. abrasive particles, to the agglomerate precursor. A small amount of water and/or solvent, or temporary organic binder precursor, for example, in an amount ranging from 5 to 15 weight %, preferably from 6 to 12 weight %, based on the weight of the agglomerate precursor, may also be added to aid in securing the inorganic particles to the surface of the abrasive agglomerate precursor.

The agglomerate precursors are then heated to burn off the organic materials used to prepare the agglomerate precursors, for example, the temporary organic binder, and to melt or vitrify the inorganic binder, which may occur separately or as one continuous step, accommodating any necessary temperature changes. The temperature to burn off the organic materials is selected to avoid excessive bubbles which may result in undesirable pores in the abrasive agglomerate and generally depends on the chemistry of the optional ingredients including the temporary organic binder precursor. Typically, the temperature for burning off organic materials ranges from about 50 to 600° C., preferably from 75 to 500° C., although higher temperatures are usable. The temperature for melting or vitrifying the inorganic binder typically ranges between 650 to 1150° C., preferably between 650 to 950° C.

The resulting agglomerates can then be thermally processed to optimize bond properties. The thermal processing comprises heating at a temperature ranging from 300 to 900° C., preferably 350 to 800° C., and more preferably 400 to 700° C.

Method of Making a Coated Abrasive Article

The followed description is a preferred but not exclusive method of making a coated abrasive. This preferred method is described with reference to a bond system comprising a make and size coat and a backing comprising a first major surface. However, the method may also include applying an abrasive slurry to a first major surface of a backing, where the abrasive slurry comprises a plurality of abrasive agglomerates and a binder precursor, each as described above, and exposing the slurry to conditions which solidify the binder precursor and form an abrasive layer. For example, the conditions can include heating, as described below for curing the make and size coats. If a low stretch backing is used, it can be prepared as described in WO 95/22438 or WO 93/12911. Otherwise, any conventional coated abrasive backing can be used.

A make coat comprising a first organic-based binder precursor can be applied to the first major surface of the backing by any suitable technique such as spray coating, roll coating, die coating, powder coating, hot melt coating or knife coating. Abrasive agglomerates, which can be prepared as described above, can be projected on and adhered in the make coat precursor, i.e., distributed in the make coat precursor. Typically, the abrasive agglomerates are drop coated to preferably achieve a monolayer. The make coat should not be of a thickness which would wick up one layer of abrasive particles and bond a second layer. In addition, the agglomerates preferably are uniformly distributed. In order to achieve an abrasive layer having a cross-section normal to the thickness and at a center point of the thickness which has a total cross-sectional area of abrasive agglomerates which is substantially the same as that at a point along the thickness which is 75% of a distance between the center point and the contact side, for example, abrasive particles having a substantially uniform size and shape are delivered to the make coat randomly so that slight variations are averaged out.

The resulting construction is then exposed to a first energy source, such as heat, ultra-violet, or electron beam, to at least partially cure the first binder precursor to form a make coat does not flow. For example, the resulting construction can be exposed to heat at a temperature between 50 to 130° C., preferably 80 to 110° C., for a period of time ranging from 30 minutes to 3 hours. Following this, a size coat comprising a second organic-based binder precursor, which may be the same or different from the first organic-based binder precursor, is applied over the abrasive agglomerates by any conventional technique, for example, by spray coating, roll coating, and curtain coating. Finally, the resulting abrasive construction is exposed to a second energy source, such as heat, an ultra-violet source, or electron beam, which may be the same or different from the first energy source, to completely cure or polymerize the make coat and the second binder precursor into thermosetting polymers.

In particular, a coated abrasive article having a bond system with a Knoop hardness of at least 70 KHN can be prepared as described above except that the filler particles used in the first and second binder precursors are calcium metasilicate combined with a silane coupling agent.

Method of Using a Coated Abrasive Article

The abrasive article can be used to abrade a workpiece. The workpiece can be any type of material such as metal, metal alloys, exotic Is metal alloys, ceramics, glass, wood, wood like materials, composites, painted surface, plastics, reinforced plastic, stones, and combinations thereof. The workpiece may be flat or may have a shape or contour associated with it. Examples of workpieces include glass eye glasses, plastic eye glasses, plastic lenses, glass television screens, metal automotive components, plastic components, particle board, camshafts, crank shafts, furniture, turbine blades, painted automotive components, and magnetic media.

During abrading, the abrasive article is moved relative to the workpiece, or vice versa, so that the abrasive article abrades the workpiece. Depending upon the application, the force at the abrading interface can range from about 0.1 kg to over 1000 kg. Typically, this range is between 1 kg to 500 kg of force at the abrading interface. In addition, abrading may occur under wet conditions. Wet conditions can include water and/or a liquid organic compound. Examples of typical liquid organic compounds include lubricants, oils, emulsified organic compounds, cutting fluids, and soaps. These liquids may also contain other additives such as defoamers, degreasers, and corrosion inhibitors. The abrasive article may oscillate at the abrading interface during use, which may result in a finer surface on the workpiece being abraded.

The abrasive article of the invention can be used by hand or used in combination with a machine such as a belt grinder. The abrasive article can be converted, for example, into a belt, tape rolls, disc, or sheet.

For belt applications, the two free ends of an abrasive sheet are joined together and spliced, thus forming an endless belt. A spliceless belt, as described in WO 93/12911, incorporated herein by reference, can also be used. Generally, an endless abrasive belt can traverse over at least one idler roll and a platen or contact wheel. The hardness of the platen or contact wheel is adjusted to obtain the desired rate of cut and workpiece surface finish. The abrasive belt speed depends upon the desired cut rate and surface finish and generally ranges anywhere from about 20 to 100 surface meters per second, typically between 30 to 70 surface meter per second. The belt dimensions can range from about 0.5 cm to 100 cm wide, preferably 1.0 to 30 cm, and from about 5 cm to 1,000 cm long, preferably 50 to 500 cm.

Abrasive tapes are continuous lengths of the abrasive article and can range in width from about 1 mm to 1,000 mm, preferably between 5 mm to 250 mm. The abrasive tapes are usually unwound, traversed over a support pad that forces the tape against the workpiece, and then rewound. The abrasive tapes can be continuously fed through the abrading interface and can be indexed.

Abrasive discs, which may also include that which is in the shape known in the abrasive art as "daisy", can range from about 50 mm to 1,000 mm in diameter, preferably 50 to 100 mm. Typically, abrasive discs are secured to a back-up pad by an attachment means and can rotate between 100 to 20,000 revolutions per minute, typically between 1,000 to 15,000 revolutions per minute.

A coated abrasive article of this invention is particularly effective at abrading a hard workpiece having a Rockwell "C" hardness of at least about 25 Rockwell "C", typically at least about 35 Rockwell "C", preferably at least about 45 Rockwell "C", and more preferably at least about 50 Rockwell "C". Such workpieces include steel and cast iron. In particular, a coated abrasive article of this invention is particularly effective at precision abrading the hard workpiece wherein the coated abrasive article is trued, as described above, prior to contacting the abrasive article with the workpiece. During the life of the article, the article can be trued when it is not within the desired specifications, for example, when the surface finish and/or grinding precision is not met.

The hardness measurements can be made according to ASTM Standard Number A370-90. Examples of hardened steel or cast iron workpieces include camshafts, crank shafts, engine components, bearing surfaces, and, generally, any machine components that must be able to withstand aggressive or moderate wear conditions for an extended period of time. The method of abrading comprises providing a coated abrasive article of this invention, contacting the coated abrasive article with a hard workpiece, and moving the coated abrasive article and the workpiece relative to each other. The workpieces may be abraded under a water flood or in the presence of a lubricant. In a preferred embodiment, the coated abrasive article comprises a backing and an abrasive layer, wherein the abrasive layer comprises a bond system and abrasive agglomerates, the agglomerates comprising a vitrified binder and superabrasive grains. agglomerates, the agglomerates comprising a vitrified binder and superabrasive grains.

One preferred aspect of this invention is to grind camshafts as described in U.S. Pat. No. 4,833,834, incorporated herein by reference, using an abrasive article of this invention.

EXAMPLES

The following non-limiting examples will further illustrate the invention. All parts, percentages, ratios, etc., in the examples are by weight unless otherwise indicated. The weights recited for make, size, and vitrified agglomerate slurry formulations are wet weights. The following abbreviations are used throughout:

DIW deionized water;

EP1 epoxy, commercially available from Shell Chemical Company (Houston, Tex.) under the trade designation "Epon 828";

EPH1 epoxy hardener, commercially available from Henkel Corporation (Minneapolis, Minn.) under the trade designation "Versamid 125";

EP2 epoxy, commercially available from Shell Chemical Co. (Houston, Tex.) under the trade designation "Epon 871";

EPH2 epoxy hardener, commercially available from Henkel Polymers Division (LaGrange, Ill.) under the trade designation "Genamid 747";

PR resole phenolic resin, containing between 0.75 to 1.4% free formaldehyde and 6 to 8% free phenol, percent solids about 78% with the remainder being water, pH about 8.5, and viscosity between about 2400 and 2800 centipoise;

SCA silane coupling agent, commercially available from Union Carbide under the trade designation "A-1100";

PH2 2-benzyl-2-N,N-dimethylamino-1-(4-morpholinophenyl)-1-butanone, commercially available from Ciba Geigy Corp. (Hawthorne, N.Y.) under the trade designation "Irgacure 369";

SWA1 wetting agent, commercially available from Akzo Chemie America (Chicago, Ill.) under the trade designation "Interwet 33";

SWA2 wetting agent, commercially available from Union Carbide Corp. (Danbury, Conn.) under the trade designation "Silwet L-7604";

SAG1 cubic boron nitride, having a 60% nickel coating, commercially available from General Electric Co. (Worthington, Ohio) under the trade designation "CBN II";

SAG2 cubic boron nitride, commercially available from General Electric Co. (Worthington, Ohio) under the trade designation "CBN I";

AO aluminum oxide abrasive grain;

MDA methylene dianaline, commercially available from BASF Corporation (Parsippany, N.J.);

MAA methacrylic acid, commercially available from Rohm and Haas (Philadelphia, Pa.);

PMA polypropylene glycol methyl ether acetate;

UPR urethane polymer, commercially available from Uniroyal Chemical Company, Inc. (Middlebury, Conn.) under the trade designation "Adiprene BL-16";

PEG4D polyethylene glycol 400 diacrylate, commercially available from Sartomer Company, Inc. (Exton, Pa.);

UAO urethane acrylate, commercially available from Morton International (Chicago, Ill.) under the trade designation "Uvithane 893";

AC amine curative, commercially available from Albemarle Corporation (Baton Rouge, La.) under the trade designation "Ethacure 100";

EGME ethylene glycol monobutyl ether, also known as polysolve, commercially available from Olin Company (Stamford, Conn.);

PS100 hydrocarbon solvent, commercially available from Exxon Chemical Co. (Houston, Tex.) under the trade designations "WC-100" and "Aromatic 100";

CMST calcium metasilicate, commercially available from NYCO (Willsboro, N.Y.) under the trade designation "325 Wollastonite";

CMSK calcium metasilicate, commercially available from NYCO (Willsboro, N.Y.) under the trade designation "400 Wollastokup";

ASF2 silica filler, commercially available from DeGussa GMBH (Germany) under the trade designation "Aerosil R-972";

ASC clay, commercially available from Engelhard Corporation (Edison, N.J.) under the trade designation "ASP 600".

Coated abrasive belts were prepared as Comparative Examples A and B and Examples 1 to 6 as follows:

Comparative Example A

The backing used for Comparative Example A was a polyester backing (360 g/m$^2$) which was presized with a 60 parts EP1/40 parts EPH1 and backsized with a 50 parts EP1/50 parts EPH1 resin filled with $CaCO_3$ and bronze powder. An abrasive slurry formulation as listed below in Table 1 was coated onto this backing by knife coating, and the resulting construction was cured at room temperature for 10 minutes, then at 90° C. for 90 minutes, and then at 113° C. for 14 hours. A conventional butt splice was used to provide endless belts, 132 inches (335.3 cm) long. The bronze filled backsize was skived off during the splicing to provide no caliper variation at the splice area. The belts were slit to 15/16 inch (2.38 cm) widths.

TABLE 1

Abrasive Slurry

| Component | Amount |
|---|---|
| DIW | 12.7 |
| ASC | 3.5 |
| PR | 33.3 |
| ASF2 | 0.8 |
| SWA1 | 0.2 |
| SAG1 (74 Micron) | 49.5 |

Comparative Example A was tested on a single belt cam shaft grinder, commercially available from Litton Landis Industries as model "3L CNC". The machine had a 50 cm diameter crowned rubber drive wheel, a three segmented polycrystalline diamond back-up shoe, and idlers located above and below the shoe, with shoulders to guide the belts. The belts were placed on the machine at a belt tension of 80–100 pounds/inch of belt width (14–17.6 N/mm), and run at a speed of 7000 surface feet per minute (35 meters/second). The workpieces ground were automotive cam shafts, having hardened steel lobes with hardnesses of 58–60 Rockwell "C". The shafts were rotated at 20 rpm during grinding. Before grinding however, the belts were dressed and trued so that the resulting ground workpieces would conform to manufacturers' tolerances. A 4 inch (10.2 cm) diameter dressing wheel, electroplated with diamonds, was rotated at 5000 rpm and brought into contact with the surface of the driven belt. The coolant used during the dressing and also grinding was a synthetic oil, Masterchemical Trim VHP E200, at 6% in water.

To obtain an acceptable surface finish and taper on the cam lobes being ground, the belts required dressing and truing with a diamond dressing wheel. The dressing process eliminated chatter and brought the surface finish of the workpiece surface down from 62 microinches (1.6 micrometers) to 16–30 microinches (0.4–0.8 micrometers).

Comparative Example B

The backing used for Comparative Example B was a spliceless construction prepared according to the disclosure of Benedict et al., WO 93/12911. The epoxy/urethane blend shown below in Table 2 was knife coated onto a thin non-woven polyester mat. Thirty threads per inch (12 per cm) each of alternating 200 denier fiberglass and polyester filaments were helically wound into the resin. The process was done on a 132 inch (335.2 cm) circumference wheel.

TABLE 2

| Fiber Bonding Resin | |
|---|---|
| Component | Amount |
| UPR | 37.4 |
| MDA | 4.4 |
| PMA | 8.2 |
| EP1 | 16.7 |
| EP2 | 16.7 |
| EPH2 | 16.7 |

The backing was spray coated with a make resin having the 5 formulation described in Table 3. SAG1 (125 micrometers average particle size) was drop coated onto the make coat at a density of 0.057 gram/square inch (0.143 g/sq. in. if the nickel coating is included) (0.0088 g/cm$^2$, or 0.022 g/cm$^2$). After a one hour pre-cure at 82° C., the size resin shown in Table 4 was spray coated over the abrasive grains. The belts were cured for 1 hour at 82° C., 14 hours at 103° C., then cured an additional 3 hours at 143° C. The belts were slit to ⅞ inch (22.2 mm) width.

TABLE 3

| Make Coat Formulation | |
|---|---|
| Component | Amount |
| DIW | 17.20 |
| SCA | 0.44 |
| CMST | 43.01 |
| CMSK | — |
| PR | 38.28 |
| ASF2 | 0.43 |
| SWA1 | 0.32 |
| SWA2 | 0.32 |

TABLE 4

| Size Coat Formulation | |
|---|---|
| Component | Amount |
| DIW | 17.20 |
| SCA | 0.44 |
| CMST | 43.01 |
| CMSK | — |
| PR | 38.28 |
| ASF2 | 0.43 |
| SWA1 | 0.32 |
| SWA2 | 0.32 |
| 85/15 PS100/DIW | — |
| P-320 AO | — |
| P-400 AO | — |

The grinding conditions were the same as for Comparative Example A. Dressing and truing the belts decreased the surface finish from 105 microinches (2.6 micrometers) to 16–40 microinches (0.4 to 1 micrometer), and eliminated chatter. After one successful dress, 120 cam shaft lobes were ground before the flatness across the lobe went out of specification. The belt wear was measured and the G-ratio, which is equal to the volume of metal removed from the cam lobes divided by the volume of belt lost during grinding, was calculated. The G-ratio can be calculated as follows:

G-ratio=(circumference of cam lobe)(width of lobe)(depth of stock removed) (length of belt)(width of lobe)(loss of belt thickness)

Comparative Example B had a G-ratio at approximately 140. The maximum stretch observed was 0.6%.

Example 1

The backing used for Example 1 was a polyester sateen fabric (285 g/m$^2$) saturated with a 90/10 phenolic/latex blend to achieve a weight of 360 g/m$^2$. The backing was slit to 12 inches (30.5 cm) wide. A 132.1 inch (335.5 cm) length was cut and conventionally butt spliced using a sine wave die at approximately a 670 angle and spliced using ¾ inch (1.9 cm) wide splicing media. The spliced belt was then slid onto a 132 inch (335.3 cm) circumference, 15 inch (38 cm) wide aluminum hub. A resin of the formulation in Table 5 was knife coated onto the backing at a thickness of about 4 to 6 mils (102 to 152 micrometers) and a weight of 0.036 g/cm$^2$. After coating the drum was rotated at 3 rpm and the acrylate portion of the resin was cured using a 600 watt/inch Fusion Systems "D" lamp for 40 seconds.

TABLE 5

| Fiber Bonding Resin | |
|---|---|
| Component | Amount |
| UPR | 48.7 |
| 35% MDA in PMA | 15.2 |
| UAO | 18.0 |
| PEG4D | 17.6 |
| PH2 | 0.5 |

A second layer of the same resin was applied at a thickness of 16 to 20 mils (406 to 508 micrometers). Alternating 400 denier (under the trade designation "Kevlar 49" available from E.I. DuPont Corp.) and 440 denier polyester fiber were wound onto the backing at 24 threads of each per inch (9.5 per cm) of belt width. The resin was smoothed, and cured for 40 seconds with the same Fusion Systems lamp. The coated belt was then exposed to two infrared curing lamps for approximately 30 minutes while the drum was rotating to cure the resin. After cooling to room temperature the backing was removed from the hub and slit to 5 inch (12.7 cm) widths for coating.

Abrasive agglomerates were formed by mixing the formulation shown in Table 8 and coating it into a silicone mold with holes having a square top approximately 0.050 inch (1270 micrometers) long and wide and a square base approximately 0.025 inch (635 micrometers) long and wide; the depth of the hole is 0.035 inch (890 micrometers). The glass powder listed in Table 8 for each of Examples 1 though 4 is described in Table 11. The slurry was dried and cured in the mold at 90° C. for 30 minutes. The resulting cubes were removed from the mold. To prevent the agglomerates from sticking together during the firing process, 100 grams of grade 220 (average particle size 74 micrometers) AO and 10.0 grams of DIW were blended with 200 grams of the pre-fired agglomerate cubes. The bottom of an alumina sagger was covered with 75 grams of grade 220 AO and the blended material was placed on top. The sagger was placed in a small furnace that was open to the air. The furnace temperature was increased from 25° C. to 900° C. over a four hour period, after which it was held at 900° C. for 3 hours, and then turned off and allowed to cool to room temperature overnight. The fired, vitrified agglomerates were screened through a 16 mesh screen to separate them from each other and collected on a 60 mesh screen to remove any fine AO.

Make resin of the formulation shown in Table 9 was knife coated onto the polyester fabric side of the backing at a wet weight of 0.22 gram per square inch (0.034 g/cm2). The agglomerates made above were drop coated onto the make resin at a weight of 0.34 gram per square inch (0.053g/cm2). The belts were placed in an oven at 90° C. for 90 minutes to pre-cure the make coat and anchor the agglomerates to the backing. The size resin shown in Table 10 was coated onto the belt using a soft (Shore A=30) rubber roll. The size resin weight was 0.41 gram per square inch (0.064 g/cm2). The belts were then oven pre-cured for 16 hours at 90° C. and final cured for 3 hours at 130° C. The belt was flexed after completion of the cure and slit to 1.0 inch (2.54 cm) widths for testing.

The belts were tested for grinding performance as follows. The grinder used was the same as described in Comparative Example A. The workpieces ground were automotive cam shafts having hardened lobes approximately 0.453 inch (1.15 cm) wide with a hardness of 58–64 Rockwell "C". Before grinding, the belts were dressed and trued by the same conditions. However, the concentration of oil in water for the coolant was 5.75%.

The belt was trued and dressed by bringing the belt into contact with a diamond dressing wheel and traversing the narrow diamond slowly back and forth across the width of the belt. When the belt thickness reached 0.0692 inch (0.176 cm) the belt was sufficiently dressed to permit successful grinding of cam shaft lobes.

The first lobe was ground at an infeed rate of 0.001 inch (25 micrometers) per revolution and the lobe had a total peak to valley variation from flatness of 0.000060 inch (1.5 micrometers) and a average surface finish of 20 microinches (0.5 micrometers). After grinding 48 lobes the surface finish was 28 microinches (0.7 micrometers) and variation from flatness was 0.000130 inch (3.3 micrometers). The wear of the belt was measured to be 0.0000045 inch (0.114 micrometers) per lobe ground. The G-ratio was calculated to be 96.

The belt was dressed and trued again. Belt thickness decreased to 0.0677 inch (0.172 cm). The first lobe was ground at an infeed rate of 0.001 inch (25.4 micrometers) per revolution of the camshaft. The surface finish was 21 microinches (0.55 micrometers) on the first lobe and the total peak to valley variation from flatness was 0.000080 inch (2.03 micrometers). After grinding 48 lobes the surface finish was 28 microinches (0.7 micrometers) and the total variation from flatness was 0.000100 inch (2.54 micrometers). The belt wear was measured to be 0.0000031 inch (0.078 micrometers) per lobe ground. The G-ratio was calculated to be 139.

The belt was dressed and trued to a belt thickness of 0.0669 inch. The infeed rate was increased to 0.0015 inch per revolution. The surface finish was 24 microinches on the first lobe and the total peak to valley variation from flatness was 0.000100 inch. After grinding 48 lobes the surface finish was 35 microinches and the total variation from flatness was 0.000210 inch. The belt wear was measured to be 0.0000075 inch per lobe ground. The G-ratio calculated to be 58.

The belt was dressed and trued to a belt thickness of 0.0659 inch. The infeed rate was decreased to 0.00067 inch per revolution. The surface finish was 21 microinches on the first lobe and the total peak to valley variation from flatness was 0.000085 inch. After grinding 48 lobes the surface finish was 23 microinches and the total variation from flatness was 0.000120 inch. After grinding 118 lobes the surface finish was 24 microinches and the total variation from flatness was 0.000170 inch. The belt wear was measured to be 0.0000021 inch per lobe ground. The G-ratio calculated to be 206.

Lobe flatness was not consistently attained in the comparative examples on the same equipment and under the same conditions using abrasive belts prepared with individual (non-agglomerated) abrasive grain.

The belt construction described above dressed and trued to acceptable flatness every time. Consistently achieving flatness of the ground cam lobes is critical for the success and utility of an abrasive belt for camshaft grinding.

Example 2

The backing used for Example 2 was prepared in a similar manner as in Example 1, except that the formulation for adhering the fibers is as shown in Table 6 and other variations from Example 1 are described below.

TABLE 6

| Fiber Bonding Resin | |
|---|---|
| Component | Amount |
| UPR | 66.5 |
| AC | 7.8 |
| MAA | 0.1 |
| PEG4D | 25.0 |
| PH2 | 0.6 |

After coating the resin onto the fibers, the drum was rotated at 3 rpm and the resin was cured using a 400 watt/inch (157.5 watt/cm) Fusion Systems "V" lamp for 60 seconds.

A second layer of the same resin was applied at a thickness of 16 to 20 mils (406 to 105 micrometers). 800 denier fibers having the trade designation "Kevlar 49" available from E.I. DuPont Corp. were wound onto the backing at 42 threads per inch (16.5 per cm) of belt width. The resin was smoothed, and cured for 60 seconds with the same Fusion Systems lamp. The coated belt was then exposed to two infrared curing lamps for approximately 120 minutes while the drum was rotating to cure the resins. After cooling to room temperature the backing was removed from the hub and slit to 5 inch (12.7 cm) widths for coating.

Vitrified agglomerates were formed by mixing a slurry as shown in Table 8 in the same manner as in Example 1. The slurry was dried and cured in the mold at 90° C. for 30 minutes, and which the cubes were removed from the mold using an ultrasonic horn. To prevent the pre-fired agglomerates from sticking together during the firing process, grade 150 AO (average particle size of about 105 micrometers) was blended with the agglomerates. The bottom of an alumina sagger was covered with grade 150 AO and the blended material was placed on top. The sagger was placed in a small furnace that was open to the air. The agglomerates were fired at 900° C. The fired, vitrified agglomerates were then screened through an ANSI 16 mesh screen to separate them from each other. The fine AO was also screened off.

The make resin as shown in Table 9 was knife coated onto the backing at a weight of 0.21 gram per square inch (0.033 g/cm2). The agglomerates from above were drop coated onto the make resin at a weight of 0.57 gram per square inch (0.088 g/cm2). The belts were placed in an oven at 90° C. for 90 minutes to pre-cure the make and anchor the agglomerates to the backing.

The size resin as shown in Table 10 was coated onto the belts using a soft (Shore A=30) rubber roll. The size resin weight was 0.50 gram per square inch (0.0775 g/cm2). The belts were then oven pre-cured for 90 minutes at 90° C., and final cured for 10 hours at 105° C. and 3 hours at 130° C. The belts were flexed after completion of the cure and slit to 0.75 to 1.0 inch (1.9 to 2.5 cm) widths for testing.

The belts were tested for grinding performance on hardened steel cam lobes. The grinder used was a prototype belt grinder from J.D. Phillips Corp. (Alpena, Mich.) but basically similar to the Litton Land is grinder. The back-up shoe was a polycrystalline diamond shoe, and idlers were located above and below the shoe, with flanges on each side of the shoe to guide the belt. The belts were run at a tension of 50–73 pounds/inch (8.8–12.8 N/mm) and driven at a speed of 7740 surface feet per minute (39.3 m/s ) by a 12 inch (30.5 cm) diameter crowned rubber drive wheel. The belts were dressed and trued with a 3 inch (7.6 cm) diameter diamond wheel rotating at 10 rpm (counter-rotating against the direction of the belts). The contact width of the diamond wheel on the belts was approximately ½ inch (1.27 cm). The rotating diamond wheel was indexed in on the left side of the belt and traversed the belt from left to right. The workpieces ground were automotive cam shafts for a V-8 engine, each lobe was approximately 0.45 inch (1.14 cm) with a hardness of 60–62 Rockwell "C". The coolant used was a synthetic oil, Cimperial 1010, in water at about 5%.

The abrasive belt thickness before dressing, truing, and grinding was approximately 0.100 inch (0.25 cm). The abrasive belt was trued and dressed by bringing the belt into contact with a diamond dressing wheel and traversing the diamond wheel slowly across the width of the belt. When the belt thickness reached 0.085 inch the belt was sufficiently dressed to permit successful grinding of cam lobes.

Each of the eight heads on the test grinder could grind two lobes on the cam shaft. The first two lobes on each shaft were ground, and the belt was then moved to the second head to grind the third and fourth lobes. The greatest number of lobes that could be ground without moving the belt was 94.

Four hundred twenty-eight (428) lobes were ground with a single belt. The belt was only slightly used at this point; therefore, it was not possible to successfully measure the wear of this belt and, thus, calculate a G-ratio.

The surface finish on the base circle of the lobes was initially about 13 microinches (0.325 micrometer) immediately after dressing. The surface finish on the base circle after grinding 180 lobes was still less than 20 microinches (0.5 micrometer). The final belt stretch was less than approximately 1.8%.

Example 3

The backing for Example 3 was prepared the same as Example 2, except the fiber bonding resin as shown in Table 7 was used.

TABLE 7

Fiber Bonding Resin

| Component | Amount |
|---|---|
| UPR | 67.2 |
| AC | 7.8 |
| MAA | 0.1 |
| PEG4D | 24.4 |
| PH2 | 0.5 |

Abrasive agglomerates were made in the same manner as in Example 2, using the slurry formulation as shown in Table 8. To prevent the pre-fired agglomerates from sticking together during the firing process grade 200/230 (average particle size 74 micrometers) SAG2 was blended with the agglomerates. The bottom of an alumina sagger was covered with grade 200/230 SAG2 and the blended material was placed on top. The sagger was placed in a small furnace that was open to the air. The agglomerates were fired at 900° C. The fired, vitrified agglomerates were then screened through an ANSI 16 mesh screen to separate them from each other. The fine SAG2 was also screened off.

The make resin as shown in Table 9 was knife coated onto the polyester fabric side of the backing at a weight of approximately 0.25 gram per square inch. The fired agglomerates were drop coated onto the make resin at a weight of 0.73 gram per square inch. The belts were placed in an oven at 90° C. for 90 minutes to pre-cure the make and anchor the agglomerates to the backing. The size resin as shown in Table 10 was coated onto the belt using a soft (Shore A=30) rubber roll. The size resin weight was 0.43 gram per square inch. The belts were then oven precured for 90 minutes at 90° C., and final cured for 10 hours at 105° C. and 3 hours at 130° C. The belts were flexed after completion of the cure and slit to 0.75 to 1.0 inch (1.9 to 2.5 cm) widths for testing.

The belts were tested for grinding performance on hardened steel cam lobes and hardened cast iron. The grinding conditions were as follows. The grinder used was the same Litton Land is grinder used in the above examples. The tension on the belts was 80–100 pounds/inch (14–17.6 N/mm), and they were driven at 6000 to 11000 surface feet per minute (30.5 to 55.9 m/s) by a 20 inch (50.8 cm) diameter crowned rubber wheel that had been roughened with a coarse abrasive to minimize the slip of the belts on the drive wheel. The belts were dressed and trued in the same manner as before. The contact width of the diamond dressing wheel on the belt surface was about ⅛ inch (0.32 cm) and the rotating wheel was indexed in on the left side of the belt and traversed across the belt to the right, after which it was indexed again and traversed across to the left. The workpieces ground were hardened steel automotive cam shafts, hardness 58–64 Rockwell "C", and cast iron cam shafts, hardness 48–50 Rockwell "C". During grinding, the cam was rotated at 20 rpm, and also oscillated 0.120 inch (0.3 cm) at 1.4 Hz. The coolant used was Masterchemical Trip VHP E200, at a concentration between 3 and 6%.

The belt thickness before dressing, truing, and grinding was approximate 0.130 inch (0.33 cm). The backing thickness was 0.050 inch (0.127 cm). The belt was coated with a single layer of agglomerates with a diameter of approximately 0.040 inch (0.102 cm). Several agglomerates were unintentionally coated as a second layer. However, these extraneous agglomerates were knocked off the belt during the initial dressing/truing sequence.

The abrasive belt was trued and dressed by bringing the belt into contact with a diamond dressing wheel and traversing the narrow diamond slowly back and forth across the width of the belt. When the belt thickness reached 0.089 inch (0.226 cm) the belt was sufficiently dressed and trued to permit successful grinding of cam lobes.

On hardened steel cam shaft lobes, under a variety of grinding conditions, the G-ratio range was 60 to 110. On hardened cast iron cam lobes, under a variety of grinding conditions, the G-ratio range was 98 to 427.

The belt stretch was less than 1.0% during testing. The belts returned to within 0.5% of their original length when removed from tension overnight.

Example 4

Example 4 was prepared by the same method as Example 3. The backing and the abrasive agglomerates were made in the same manner as the backing of Example 3, except that the resulting abrasive belts were 158 inches (400 cm) long and 1.0 inch (2.54 cm) wide.

The make resin as shown in Table 9 was knife coated onto the polyester fabric side of the backing at a weight of approximately 0.21 gram per square inch (0.033 g/cm2). The agglomerates from above were drop coated onto the make resin at a weight of 0.68 gram per square inch (0.105 g/cm2). The belts were placed in an oven at 90° C. for 90 minutes to pre-cure the make and anchor the agglomerates to the backing.

The size resin as shown in Table 10 was coated onto the belt using a soft (Shore A=30) rubber roll. The size resin weight was 0.27 gram per square inch (0.042 g/cm2). The belts were then oven pre-cured for 90 minutes at 90° C., and final cured for 10 hours at 105° C. and 3 hours at 130° C. The belts were flexed after completion of the cure and slit to 1.0 inch (2.54 cm) widths for testing.

The belts were tested as follows. The grinder used was a single belt cam shaft grinder from Schaudt of Germany, model CBS1. The back-up shoe was 1.07 inches (2.73 cm) wide, and crowned idlers were located above and below the shoe. The tension on the belts was 50 pounds per inch (8.8 N/mm), and the belts were driven at 9000 surface feet per minute (45 m/s) by a 15 inch (38 cm) diameter, 3 inch (7.5 cm) wide rubber wheel which was roughened with a coarse abrasive to minimize the slip of the belt on the drive wheel. The workpieces ground were hardened cast iron automotive cam shafts (the Rockwell "C" hardness was 54 on the ramp and nose and 42 on the base) and approximately 0.5 inch (13 mm) wide. The coolant used during grinding was Oemeta Frigimet MA 174-N, 2.5% in water.

The abrasive belts were dressed and trued using a 5.9 inch (15 cm) diameter, 0.012 inch (0.3 mm) wide diamond wheel counter-rotating at 3000 ft/min (15 m/s). The rotating diamond wheel was indexed in on the right side of the belt and traversed across the belt from right to left, then indexed in again and traversed from right to left.

One hundred ninety cam shafts, or 1520 cam lobes were ground using a grinding cycle that required 34 seconds per lobe. The belt was dressed and trued every five cam shafts (40 lobes) at the beginning of the test. The number of shafts ground between dresses and trues was gradually increased to thirty-six (288 lobes) as it was confirmed that the parts were remaining within specification. The overall G-ratio calculated for grinding the 1520 lobes was 300, which was low, however, because the belts were being dressed and trued too frequently early in the tests. The G-ratio calculated for the last 560 lobes ground with this cycle time was 1000. The belt stretch was less than 0.7% during testing.

Table 8 shows the formulations used for the preparation of the abrasive agglomerate slurries for the abrasive agglomerates of Examples 1 through 4.

TABLE 8

Vitrified Agglomerate Slurry

| Component | Example 1 | Example 2 | Example 3 | Example 4 |
|---|---|---|---|---|
| SAG2 | 47.2 | 56.8 | 47.2 | 47.2 |
| Grade | 200/230 | 120/140 | 140/170 | 140/170 |
| Glass Powder | 17.7 | 21.2 | 17.7 | 17.7 |
| EP1 | 6.8 | 2.7 | 6.8 | 6.8 |
| EPH1 | 3.0 | 1.2 | 3.0 | 3.0 |
| PS100 | 3.0 | 3.9 | 3.0 | 3.0 |
| 85/15 PS100/DIW | 22.3 | 14.2 | 22.3 | 22.3 |

Tables 9 and 10 describe the make coat and size coat formulations, respectively, for Examples 1 through 4.

TABLE 9

Make Coat Formulations

| Component | Example 1 | Example 2 | Example 3 | Example 4 |
|---|---|---|---|---|
| DIW | 17.6 | 10.83 | 10.83 | 10.83 |
| SCA | 0.5 | 0.20 | 0.20 | 0.20 |
| CMST | 43.4 | — | — | — |
| CMSK | — | 51.10 | 51.10 | 51.10 |
| PR | 37.7 | 36.57 | 36.57 | 36.57 |
| ASF2 | 0.4 | 0.80 | 0.80 | 0.80 |
| SWA1 | 0.2 | 0.25 | 0.25 | 0.25 |
| SWA2 | 0.2 | 0.25 | 0.25 | 0.25 |
| Knoop Hardness | 88–89 | 90–100 | 90–100 | 90–100 |

TABLE 10

Size Coat Formulations

| Component | Example 1 | Example 2 | Example 3 | Example 4 |
|---|---|---|---|---|
| DIW | 12.3 | 17.70 | 17.70 | 17.70 |
| SCA | 2.0 | 0.30 | 0.30 | 0.30 |
| CMST | 32.9 | — | — | — |
| CMSK | — | 52.00 | 52.00 | 52.00 |
| PR | 30.0 | 29.00 | 29.00 | 29.00 |
| ASF2 | 0.4 | 0.50 | 0.50 | 0.50 |
| SWA1 | 0.2 | 0.25 | 0.25 | 0.25 |
| SWA2 | 0.2 | 0.25 | 0.25 | 0.25 |
| 85/15 PS100/DIW | 4.2 | — | — | — |
| P-320 AO | 8.9 | — | — | — |
| P-400 AO | 8.9 | — | — | — |
| Knoop Hardness | 100–105 | 100–105 | 100–105 | 100–105 |

The glass powder shown in Table 11 was used in the slurries according to Table 8. The glass powder was ground to be finer than 325 mesh. The glass was formulated so that its coefficient of thermal expansion is approximately the same as the coefficient of thermal expansion of the superabrasive grains used in the examples ($3.5\times10^{-6}$/° C.). The epoxy resin acts as a temporary binder for the agglomerates. Boron oxide is added to the formulation to encourage adhesion between the glass and the abrasive grains.

TABLE 11

Glass Powder Formulation

| Component | Amount |
|---|---|
| $SiO_2$ | 51.5% |
| $B_2O_2$ | 27.0% |
| $Al_2O_3$ | 8.7% |
| MgO | 7.5% |
| ZnO | 2.0% |
| CaO | 1.1% |
| $Na_2O$ | 1.0% |
| $K_2O$ | 1.0% |
| $Li_2O$ | 0.5% |
| total | 100.0% |

What is claimed is:

1. A coated abrasive article comprising:

(a) a low stretch backing having a first major surface; and (b) an abrasive layer coated on the first major surface, the abrasive layer having a contact side adhered to the first major surface, an opposite side, and a thickness which extends from the contact side to the opposite side, the abrasive layer comprising (i) an organic-based bond system, and (ii) a plurality of abrasive agglomerates adhered in the bond system, each of the agglomerates (1) comprising an inorganic binder and a plurality of abrasive grains, wherein the inorganic binder has a coefficient of thermal expansion which is the same or substantially the same as a coefficient of thermal expansion of the plurality of abrasive grains, and (2) having a substantially uniform size and shape, wherein a cross-section of the abrasive layer normal to the thickness and at a center point of the thickness has a total cross-sectional area of abrasive agglomerates which is substantially the same as that at a point along the thickness which is 75% of a distance between the center point and the contact side.

2. A method of making a coated abrasive article comprising:

(a) providing a low stretch backing having a first major surface;

(b) forming an abrasive layer, the abrasive layer having a contact side adhered to the first major surface of the backing, an opposite side, and a thickness which extends from the contact side to the opposite side, wherein a cross-section of the abrasive layer normal to the thickness and at a center point of the thickness has a total cross-sectional area of abrasive agglomerates which is substantially the same as that at a point along the thickness which is 75% of a distance between the center point and the contact side, comprising:

(1) applying a make coat comprising a first organic-based binder precursor to the first major surface of the backing;

(2) providing a plurality of abrasive agglomerates (i) comprising an inorganic binder and a plurality of abrasive grains, wherein the inorganic binder has a coefficient of thermal expansion which is the same or substantially the same as a coefficient of thermal expansion of the plurality of abrasive grains, and (ii) having a substantially uniform size and shape;

(3) distributing the agglomerates in the make coat;

(4) exposing the make coat to an energy source to at least partially cure the first binder precursor;

(5) applying a size coat comprising a second organic-based binder precursor on the abrasive agglomerates; and (6) exposing the size coat to a second energy source to cure the second binder precursor and, optionally, to complete curing of the first binder precursor.

3. The coated abrasive article of claim 1 wherein the low stretch backing has a percent stretch of less than about 2%.

4. The coated abrasive article of claim 1 wherein the low stretch backing has a percent stretch of less than about 1%.

5. The coated abrasive article of claim 1 wherein the low stretch backing has a percent stretch of less than about 0.5%.

6. The coated abrasive article of claim 1 wherein the inorganic binder is an inorganic metal oxide binder.

7. The coated abrasive article of claim 1 wherein the coefficient of thermal expansion of the inorganic binder is substantially the same as the coefficient of thermal expansion of the abrasive grains.

8. The coated abrasive article of claim 1, wherein the bond system comprises a make coat and a size coat.

9. The coated abrasive article of claim 8 wherein at least one of the make coat and the size coat comprise a thermoset polymer and inorganic filler particles.

10. The coated abrasive article of claim 9 wherein the thermoset polymer is selected from the group consisting of thermoset phenolic resins and bismaleimide resins.

11. The coated abrasive article of claim 8 wherein at least one of the make coat and the size coat has an average Knoop hardness of at least 70 KHN.

12. The coated abrasive article of claim 8 wherein at least one of the make coat and the size coat has an average Knoop hardness of at least 80 KHN.

13. The coated abrasive article of claim 8 wherein at least one of the make coat and the size coat has an average Knoop hardness of at least 90 KHN.

14. The coated abrasive article of claim 8 wherein at least one of the make coat and the size coat comprises a coupling agent and calcium metasilicate filler particles.

15. The coated abrasive article of claim 1 wherein the abrasive grains are superabrasive grains.

16. The coated abrasive article of claim 15 wherein the superabrasive grains are selected from the group consisting of diamond, cubic boron nitride, and combinations thereof.

17. The coated abrasive article of claim 1 wherein the abrasive agglomerates have a coating of inorganic particle.

18. The coated abrasive article of claim 1 wherein each of the agglomerates is in the shape of a truncated four-sided pyramid.

19. The coated abrasive article of claim 1 wherein each of the agglomerates is in the shape of a cube.

20. The coated abrasive article of claim 1 wherein the bond system comprises calcium metasilicate particles.

21. A coated abrasive article comprising:

(1) a low stretch backing having a first major surface; and (2) an abrasive layer coated on the first major surface, the abrasive layer comprising:

(a) an organic-based bond system, and (b) a plurality of abrasive agglomerates distributed in the bond system, each of the agglomerates comprising an inorganic binder and a plurality of abrasive grains and being in the shape of a truncated four-sided pyramid or a cube, wherein the inorganic binder has a coefficient of thermal expansion which is the same or substantially the same as a coefficient of thermal expansion of the plurality of abrasive grains.

22. A coated abrasive article comprising:

(1) a low stretch backing having a first major surface; and (2) an abrasive layer coated on the first major surface, the abrasive layer comprising:

(a) an organic-based bond system, the bond system comprising a binder and inorganic filler particles and having an average Knoop hardness number of at least 70, and (b) a plurality of abrasive agglomerates distributed in the bond system, each of the agglomerates comprising an inorganic binder and a plurality of abrasive grains, wherein the inorganic binder has a coefficient of thermal expansion which is the same or substantially the same as a coefficient of thermal expansion of the plurality of abrasive grains.

23. The coated abrasive article of claim 1 wherein the abrasive grains are aluminum oxide.

24. The coated abrasive article of claim 1 wherein the abrasive grains are a mixture of superabrasive grains and conventional grains.

25. The coated abrasive article of claim 6 wherein the inorganic metal oxide binder is a borosilicate glass.

26. A coated abrasive article, comprising:

a) a low stretch cloth backing having a first major surface;

b) an abrasive layer coated on the first major surface, the abrasive layer having a contact side adhered to the first major surface, an opposite side, and a thickness which extends from the contact side to the opposite side, the abrasive layer comprising:

i) an organic based bond system having a Knoop hardness greater than about 70, comprising a phenolic binder and filler particles; and ii) a plurality of abrasive agglomerates adhered in the bond system, each of the agglomerates comprising an inorganic binder and a plurality of abrasive grains;

wherein the coated abrasive article is a coated abrasive belt.

27. The abrasive article of claim 26 wherein the abrasive grains are selected from the group consisting of diamond, cubic boron nitride, and combinations thereof.

28. The abrasive article of claim 26, wherein the filler particles are calcium metasilicate.

29. The abrasive article of claim 26, wherein the cloth backing comprises synthetic yarns, said synthetic yarns being polyester yarns, polypropylene yarns, glass yarns, polyvinyl alcohol yarns, polyaramid yarns, polyimide yarns, aromatic polyamide yarns, rayon yarns, nylon yarns, polyethylene yarns, and combinations thereof.

30. The abrasive article of claim 26, wherein the plurality of abrasive agglomerates comprises a binder, the binder being a vitrified binder.

31. The abrasive article of claim 26, wherein the bond system has a Knoop hardness of at least 90.

32. The abrasive article of claim 26, wherein the abrasive agglomerate has a shape of a cube or a four-side pyramid.

33. The abrasive article of claim 26, wherein the cloth backing is a woven fabric backing, a knitted backing, a stitchbonded fabric backing, or a weft insert fabric backing.

* * * * *

UNITED STATES PATENT AND TRADEMARK OFFICE

CERTIFICATE OF CORRECTION

PATENT NO. : 5,975,988
DATED : November 2, 1999
INVENTOR(S) : Christianson, Todd J.

It is certified that error appears in the above-identified patent and that said Letters Patent is hereby corrected as shown below:

Title page,
Item [57], ABSTRACT,
Line 1, insert -- article -- following "abrasive" and preceding "having".
Line 2, insert -- surface -- following "major" and preceding "of".

Column 6,
Line 29, delete "yams," and insert in place thereof -- yarns, --.

Column 7,
Line 30, delete "defore" and insert in place thereof -- before --.

Column 13,
Line 29, delete ""substantially"0" and insert in place thereof -- "substantially" --.

Column 17,
Line 28, delete "Is" following "exotic" and preceding "metal".

Column 22,
Line 7, delete "670" and insert in place thereof -- 67º --.
Line 46, delete "though" and insert in place thereof -- through --.

Column 25,
Line 4, delete "Land is" and insert in place thereof -- Landis --.

Column 26,
Line 22, delete "Land is" and insert in place thereof -- Landis --.

Signed and Sealed this

Thirteenth Day of August, 2002

*Attest:*

*Attesting Officer*

JAMES E. ROGAN
*Director of the United States Patent and Trademark Office*